United States Patent [19]

Sakamoto et al.

[11] 4,328,681

[45] May 11, 1982

[54] ELECTRIC REFRIGERATOR WITH AN AUTOMATIC ICE-MAKING UNIT

[75] Inventors: Shigetoshi Sakamoto; Nobuya Suzuki, both of Toyoake, Japan

[73] Assignee: Hoshizaki Electric Co., Ltd., Toyoake, Japan

[21] Appl. No.: 164,020

[22] Filed: Jun. 30, 1980

Related U.S. Application Data

[63] Continuation of Ser. No. 951,727, Oct. 16, 1978, abandoned.

[30] Foreign Application Priority Data

Oct. 27, 1977 [JP] Japan ..... 52-128994

[51] Int. Cl.[3] ..... G05D 23/32; F25C 1/14

[52] U.S. Cl. ..... 62/157; 62/344; 62/354; 62/524

[58] Field of Search ..... 62/354, 344, 524, 464, 62/157, 265, 337

[56] References Cited

U.S. PATENT DOCUMENTS

| | | | |
|---|---|---|---|
| 1,933,042 | 10/1933 | Belshaw | 62/464 X |
| 2,024,599 | 12/1935 | Quinn | 62/337 X |
| 2,077,982 | 4/1937 | Bixby et al. | 62/337 |
| 2,143,239 | 1/1939 | Foltz | 62/337 X |
| 3,062,018 | 11/1962 | Baker | 62/157 X |
| 3,199,305 | 8/1965 | Frohbieter | 62/344 |
| 3,371,505 | 3/1968 | Raver et al. | 62/354 X |
| 3,769,809 | 11/1973 | Robinson et al. | 62/354 X |
| 3,788,089 | 1/1974 | Graves | 62/520 X |

*Primary Examiner*—William E. Tapolcai, Jr.

*Attorney, Agent, or Firm*—Wenderoth, Lind & Ponack

[57] ABSTRACT

An electric refrigerator with an automatic ice-making unit which comprises in combination a cooling unit including a compressor, a condenser and an evaporator with a refrigerating chamber and an auger type automatic ice-making unit with an ice-storing chamber.

4 Claims, 11 Drawing Figures

ELECTRIC REFRIGERATOR WITH AN AUTOMATIC ICE-MAKING UNIT

This application is a continuation of application Ser. No. 951,727, filed Oct. 16, 1978, now abandoned.

BACKGROUND OF THE INVENTION

This invention relates to an electric refrigerator equipped with an automatic ice-making unit.

Heretofore, a refrigerator has been proposed in which a refrigerating chamber is combined with various types of ice-making units such as an atmospheric type which produces ice in an ice making unit arranged in a freezing chamber under the low temperature atmosphere of the freezing chamber provided for the refrigerator, or a circulation type which produces ice by supplying the water to an ice-making plate maintained at a low temperature to form ice with subsequent heating of the plate for removing the ice. To obtain a desired amount of the ice, however, the former type requires an extremely long time for ice-making due to poor cooling efficiency while the latter type requires the ice-removing operation, resulting in a substantially long time for one cycle of the ice-making with limitation in an ice-making capacity per day. Therefore, the refrigerator equipped with the conventional ice-making unit is disadvantageous for business use requiring a high ice-making capacity.

Further, in the known refrigerator equipped with the conventional ice-making unit, the ice produced in the ice-making unit is stored in the ice-storing chamber communicating with the refrigerating chamber so that the cold air in the ice-storing chamber is introduced into the refrigerating chamber. In the refrigerator of this type, the ice-storing chamber must be arranged above the refrigerating chamber in order to increase the cooling efficiency. As a result, the ice-making unit must be also positioned above the refrigerating chamber, resulting in enlargement of the refrigerator with less stability and inconvenience in maintenance and inspection of the ice-making unit.

After intensive studies, the inventors have found that the most preferred ice-making unit to be combined with the refrigerator is an auger type ice-making unit which is compact in structure and permits a continuous production of the ice and a transportation of the ice in any desired direction. The auger type ice-making unit usually comprises a cooling cylinder opened at its upper end and provided at its outer periphery with an evaporator, a water supply pipe communicating with a bottom of the cooling cylinder, an auger rotatably mounted in the cooling cylinder to scrape off a thin ice layer formed on an inner peripheral surface of the cooling cylinder with upward transfer of the scraped ice, and a driving means for turning the auger. It has been confirmed that utilization of the auger type ice-making unit brings the following advantages:

a. Since the ice-removing operation is ommited, the ice-making capacity has been extremely increased.
b. Since the ice produced in the ice-making unit is transferred very conveniently, the ice-storing chamber may be arranged at the uppermost place or any desired place in the refrigerator.
c. The refrigerating chamber may also be positioned at the most convenient location of the refrigerator with a sufficient volume.

In the auger type ice-making unit, an ice compression die is provided at an upper end of the cooling cylinder to compress the scraped ice into ice masses, and the resultant ice masses are smoothly and continuously transferred to the desired place through a flexible tube, hence the location of the ice-making unit may be optionally selected.

Thus, it has also been found that with utilization of the auger type ice-making unit the cooling unit and the ice-making unit may be arranged together at the bottom of the refrigerator and the refrigeration system serving for the both units may be operated by a common compressor which enables simplification of the controlling system and compactness of the apparatus with less production cost as well as electricity consumption.

In order to employ a common compressor operable for both the cooling unit and the auger type automatic ice-making unit, a cooling evaporator of the auger type ice-making unit is connected in parallel to an evaporator of the cooling unit and the change-over valves for refrigerant are connected to the inlets of the respective evaporators. The change-over valve connected to the evaporator of the cooling unit is controlled by a temperature sensitive element arranged in the refrigerating chamber while the other change-over valve connected to the cooling evaporator of the auger type automatic ice-making unit is controlled by an ice detecting switch arranged in the ice-storing chamber. Thus, it has been found that the refrigeration of the refrigerating chamber and the supply of the ice into the ice-storing chamber may be separately and smoothly controlled.

SUMMARY OF THE INVENTION

It is, therefore, a general object of the invention to provide an electric refrigerator with an automatic ice-making unit of a structure which is stable and convenient in use and ensures an economical and efficient operation.

A principal object of the invention is to provide an electric refrigerator with an automatic ice-making unit which comprises in combination a cooling unit including a compressor, a condenser and an evaporator with a refrigerating chamber refrigerated by the cooling unit and an auger type automatic ice-making unit with an ice-storing chamber for storing the ice produced by the auger type automatic ice-making unit.

In the electric refrigerator according to the invention, it is preferred to use the auger type automatic ice-making unit which comprises a cooling cylinder provided at its outer periphery with an evaporator derived from a refrigeration system, a water supply pipe communicating with a bottom of the cooling cylinder, an auger unit rotatably mounted within the cooling cylinder to scrape off a thin ice layer formed on an inner peripheral surface of the cooling cylinder while transferring the scraped ice upwardly and a driving means for turning the auger.

As hereinbefore described, the cooling cylinder is provided at its upper end with the ice compression die so that ice masses of a size larger than a given size may be obtained.

According to the present invention, both the cooling unit and the auger type automatic ice-making unit may be operated with a common compressor. In this case, the evaporators of the cooling unit and of the auger type automatic ice-making unit are preferably connected through respective change-over valves in parallel to the refrigeration system including a single compressor so that one change-over valve may be switched by means of a temperature sensitive element arranged in the refrigerating chamber for detecting a chamber temperature while the other change-over valve may be switched by means of an ice detecting switch arranged in the ice-storing chamber.

Further, the evaporator of the cooling unit is connected to a delivery side of the compressor through a hot gas bypass line having a hot gas valve which is periodically energized for opening by means of a convenient manner such as a cam timer or the like while all of the change-over valves for the refrigerant are closed, so that the evaporator of the refrigerating chamber may be conveniently defrosted to appropriately control the temperature in the refrigerating chamber.

Other objects and advantages of the present invention will be readily apparent and understood from the following description and the accompanying drawings.

DESCRIPTION OF THE PREFERRED EMBODIMENTS

Figure 1:
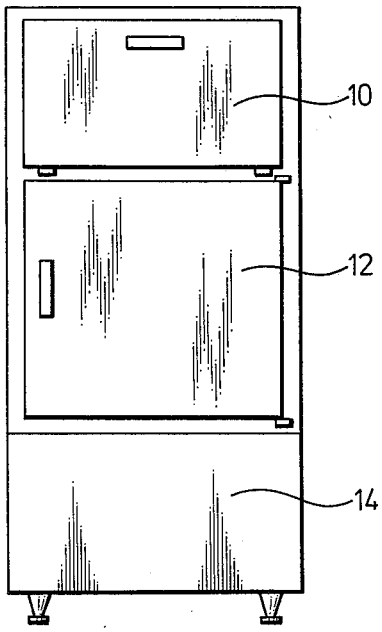
FIG. 1 is a front elevation of the electric refrigerator with an automatic ice-making unit of one embodiment according to the present invention.
Figure 2:
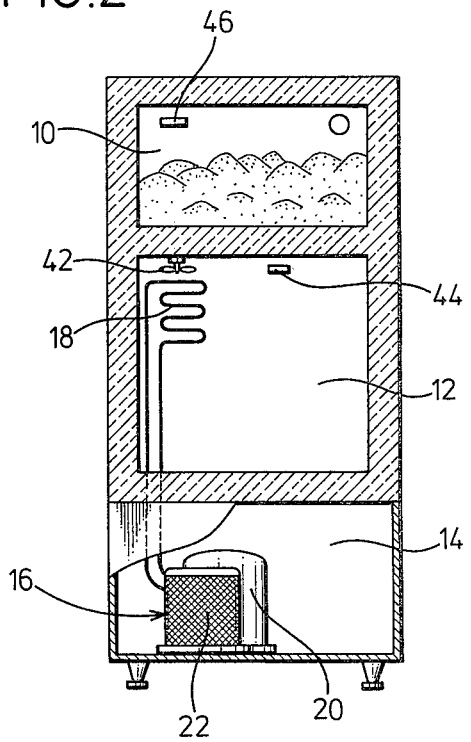
FIG. 2 is a longitudinally sectioned front elevation of the electric refrigerator of FIG. 1.
Figure 3:
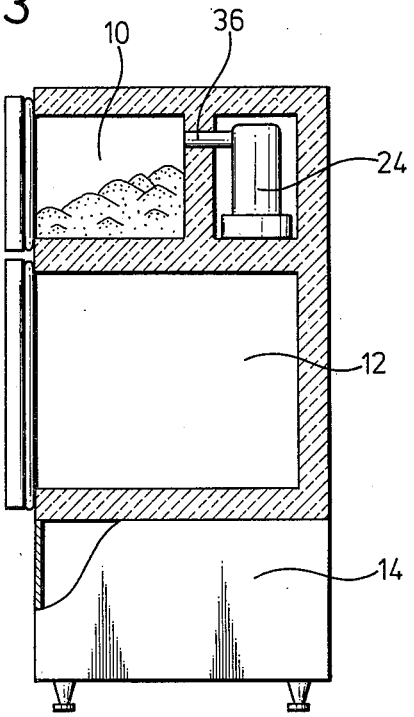
FIG. 3 is a longitudinally sectioned view of the electric refrigerator of FIG. 1.

FIGS. 1 to 3 show an embodiment of the electric refrigerator according to the present invention, in which an ice-storing chamber 10 is arranged above a refrigerating chamber 12 and a machine chamber 14 is arranged in the bottom of the refrigerator. A cooling unit 16 for cooling the refrigerating chamber 12 includes an evaporator 18 arranged in the chamber 12 and a compressor 20 with a condenser 22 arranged in the machine chamber 14. An auger type automatic ice-making unit 24 may be arranged behind the ice-storing chamber 10 or at the bottom of the refrigerator.

Figure 4:
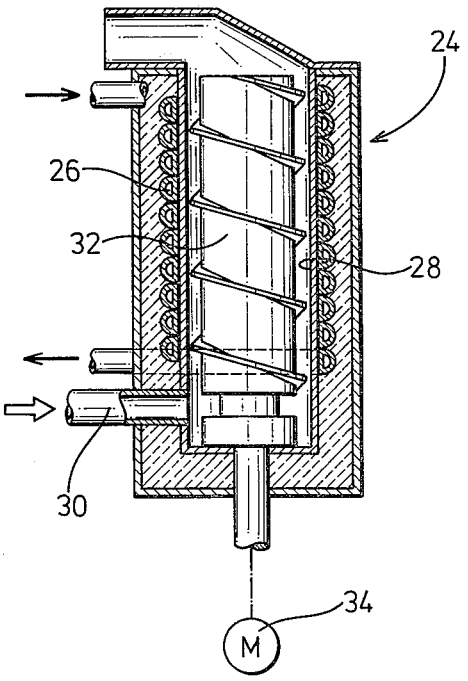
FIG. 4 is a sectional view of an embodiment of the auger type ice-making unit to be used in the electric refrigerator with the automatic ice-making unit according to the present invention.

As best shown in FIG. 4, the auger type automatic ice-making unit 24 is comprised of, for example, a cooling cylinder 28 with an open upper end and provided at its outer periphery with an evaporator 26, a water supply pipe 30 communicating with a bottom of the cylinder 28, an auger unit 32 rotatably mounted in the cylinder 28 to scrape off a thin ice layer formed on an inner peripheral surface of the cylinder 28 while transferring the scraped ice upwardly and a motor 34 for turning the auger unit 32. The flaky ice when arrived at the upper end of the auger 32 is introduced into the ice-storing chamber 10 through a passage 36 formed in a partition wall defining the ice-storing chamber 10 as shown in FIG. 3. The refrigeration system including the evaporator 26 for cooling the cylinder 28 may be conveniently arranged in the machine chamber 14.

Figure 5:
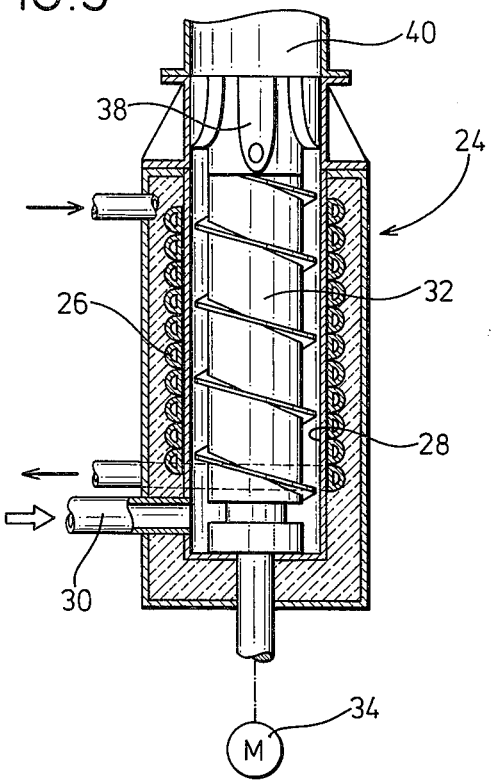
FIG. 5 is a sectional view of the auger type ice-making unit of another embodiment.
Figure 6:
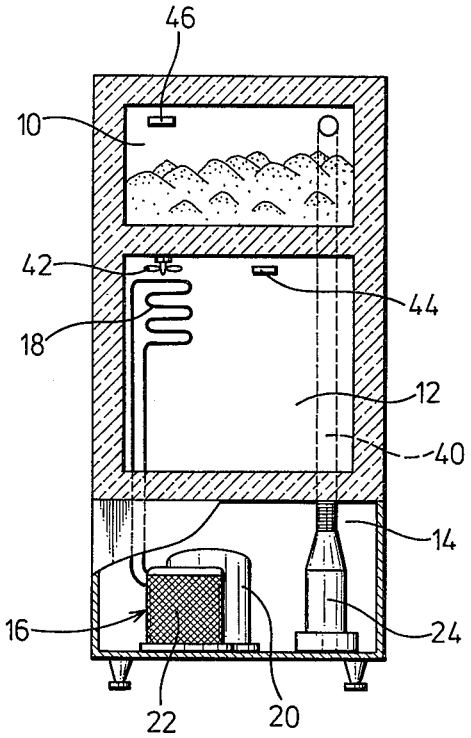
FIG. 6 is a sectional front elevation of another embodiment of the electric refrigerator equipped with the auger type ice-making unit of FIG. 5.

In FIG. 5, the cylinder 28 at its upper end is provided with a compression die 38 from which the compressed ice chips are delivered. The auger type automatic ice-making unit 24 of this structure may be arranged in the machine chamber 14 located at the bottom of the refrigerator and the ice chips produced may be continuously transported from the delivery of the compression die 38 through a flexible pipe 40 to the ice-storing chamber 10 as shown in FIG. 6.

Further, a fan 42 and a temperature sensitive element 44 for detecting the chamber temperature are arranged in the refrigerating chamber 12 for causing convection of the cold air while detecting the temperature in the chamber 12 to always hold the chamber 12 within the predetermined range of temperature. Moreover, an ice detecting switch 46 is provided in the ice-storing chamber 10 so as to discontinue operation of the ice-making unit 24 when the ice storing comes to the predetermined quantity.

Returning to FIG. 1, a door is independently provided for the front of the ice-storing chamber 10 so that the stored ice may conveniently be taken out without disturbing the refrigerating chamber 12. The water precipitated in the ice-storing chamber 10 may be collected at the bottom thereof and discharged through a drainage pipe (not shown).

Figure 7:
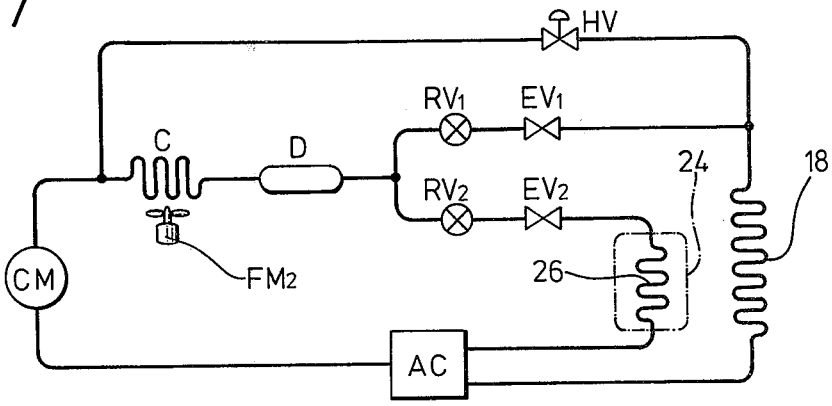
FIG. 7 is an electric circuit of the refrigeration system of the electric refrigerator of FIGS. 1 to 3.

FIG. 7 shows a control circuit of the refrigeration system of the embodiment as hereinbefore described in which the evaporator 18 of the cooling unit 16 and the evaporator 26 of the auger type ice-making unit 24 are connected in parallel to the refrigeration system including a single compressor CM and an air-cooled condenser C. Thus, the refrigerant compressed by the compressor CM is transferred to the condenser C through a single pipe and divided into two streams after passed through a dryer D and then the streams pass through change-over valves $RV_1$, $RV_2$ and expansion valves $EV_1$, $EV_2$ respectively. One stream of the refrigerant is, then, supplied to the evaporator 18 arranged in the refrigerating chamber 12, and the other stream is supplied to the evaporator 26 of the ice-making unit 24 for cooling the refrigerating chamber 12 and producing ice in the ice-making unit 24 respectively. The refrigerant evaporated at the evaporators 18 and 26 is collected in an accumulator AC for subsequent recirculation into the electric compressor CM. Preferably, a hot gas bypass line having a hot gas valve HV is extended to the evaporator 18 of the refrigerating chamber 12 to utilize hot gas delivered from the compressor CM for defrosting the evaporator 18.

Figure 8:
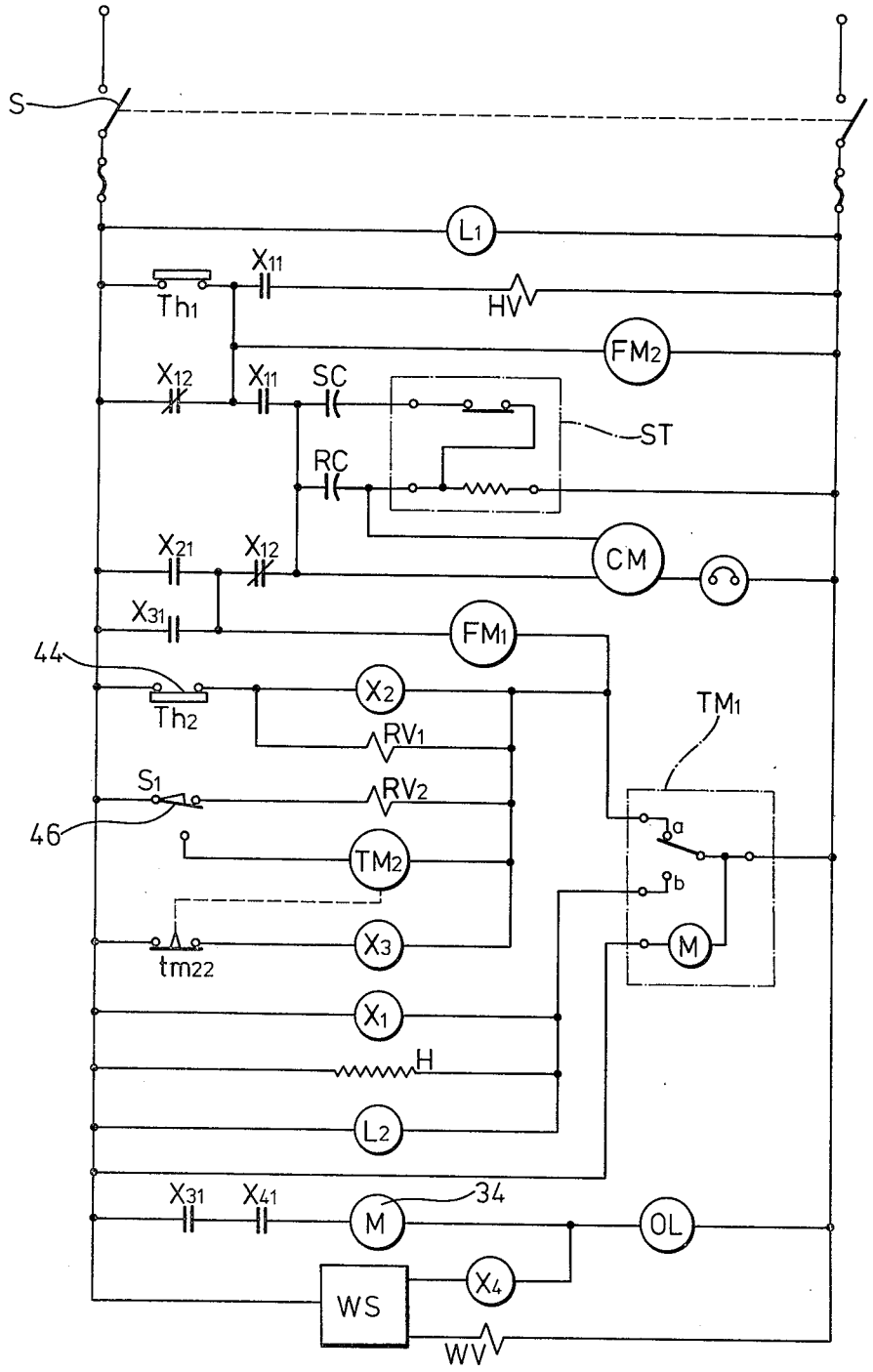
FIG. 8 is a control circuit of the refrigeration system of FIG. 7.

In the foregoing refrigeration system including the cooling unit 16 and the ice-making unit 24, the necessary control thereof may be carried out by a control circuit as shown in FIG. 8. Namely, the compressor CM is controlled by a cam timer $TM_1$. If a contact of the cam timer $TM_1$ is connected to a contact "a", the temperature sensitive element (44) $Th_2$ becomes conductive when the temperature of the refrigerating chamber 12 is still high and as a result a relay $X_2$ is energized while the change-over valve $RV_1$ for the refrigerating chamber 12 is simultaneously energized to open. Further, the relay $X_3$ is also energized thereby to close the normally opened contacts $X_{21}$ and $X_{31}$ cooperative with the relays $X_2$ and $X_3$. Thus, the compressor CM and a fan motor $FM_1$ of the condenser C are energized. Since the change-over valve $RV_1$ is opened, the evaporator 18 of the refrigerating chamber 12 brings a refrigerating operation and the fan motor $FM_2$ is also energized to operate a fan 42 provided in the refrigerating chamber 12.

When the ice-storing chamber 10 is not filled with the predermined amount of ice, the ice detecting switch (46) $S_1$ is conductive with the contact "a" so that the change-over valve $RV_2$ of the ice-making unit 24 is energized to open and activate the ice-making operation of the unit 24. When the temperature in the refrigerating chamber 12 comes below the predetermined level, the temperature sensitive element (44) $Th_2$ becomes nonconductive and as a result the relay $X_2$ is deenergized to close the change-over valve $RV_1$ so that the refrigerating operation of the evaporator 18 in the refrigerating chamber 12 is discontinued. When the ice-storing chamber 10 is filled with the predetermined amount of ice after the continuous ice making operation of the ice-making unit 24, the ice detecting switch $S_1$ becomes conductive with a contact "b" thereby to close the change-over valve $RV_2$ while energizing delay relay $TM_2$. After a predetermined time interval (approximately 10 seconds) a normally closed contact $tm_{22}$ is opened in cooperation with the delay relay $TM_2$ to deenergize the relay $X_3$. Thus, the ice making operation of the unit 24 and the operation of the compressor CM are discontinued simultaneously. When the temperature in the refrigerating chamber 12 is elevated or the amount of the ice stored in the ice-storing chamber 10 is decreased, the temperature sensitive element (44) $Th_2$ or the ice detecting switch (46) $S_1$ timely energizes the relay $X_2$ or the relay $X_3$ thereby to restart the operation of the compressor CM for the refrigeration of the refrigerating chamber 12 or the ice-making operation of the unit 24.

When the ice-making unit 24 is operated, a motor 34 for driving the auger 32 is also energized. The motor 34 is energized along the energization of the relay $X_3$ when a relay $X_4$ is energized under action of a water level switch WS for detecting a predetermined water supply in the cylinder 28 to close a normally opened contact $X_{41}$ cooperative with the relay $X_4$. When the water level in the cooling cylinder 28 goes down, the level switch WS actuates a water valve WV arranged in a water supply pipe 30 to open for supplying water of the predetermined amount to the cooling cylinder 28.

The cam timer $TM_1$ also controls the defrosting of the evaporator 18 arranged in the refrigerating chamber 12. The control for the defrosting is started when the cam timer $TM_1$ is connected to the contact "b" at the predetermined time interval. Namely, when the cam timer $TM_1$ is connected to the contact "b", the relays $X_2$ and $X_3$ are deenergized to cease the refrigeration of the refrigerating chamber 12 and the ice-making operation of the unit 24. When the relay $X_1$ is energized to close the normally opened contact $X_{11}$ while opening the normally closed contact $X_{12}$ in cooperation with the relay $X_1$, the compressor CM is energized and the fan motor $FM_1$ of the condenser C is deenergized with energizing of the fan motor $FM_2$ arranged in the refrigerating chamber 12, and the hot gas valve HV is opened to supply the hot gas to the evaporator 18 for the defrosting. The water produced during the defrosting operation is conveniently collected into a discharge plate communicated with the drainage pipe. During the defrosting operation a lamp $L_2$ is lighted to indicate the state of defrosting and a heater arranged in the discharge plate is energized to prevent the collected water from freezing on the plate. The defrosting is finished when a temperature sensitive element $Th_1$ arranged in the evaporator 18 for detection of the defrosting detects the temperature and becomes nonconductive. When the cam timer $TM_1$ is connected to the contact "a" after the predetermined time interval $t_2$ (for example approximately 25 minutes), the refrigeration of the refrigerating chamber 12 and the ice-making operation of the unit 24 are restarted.

Figure 9:
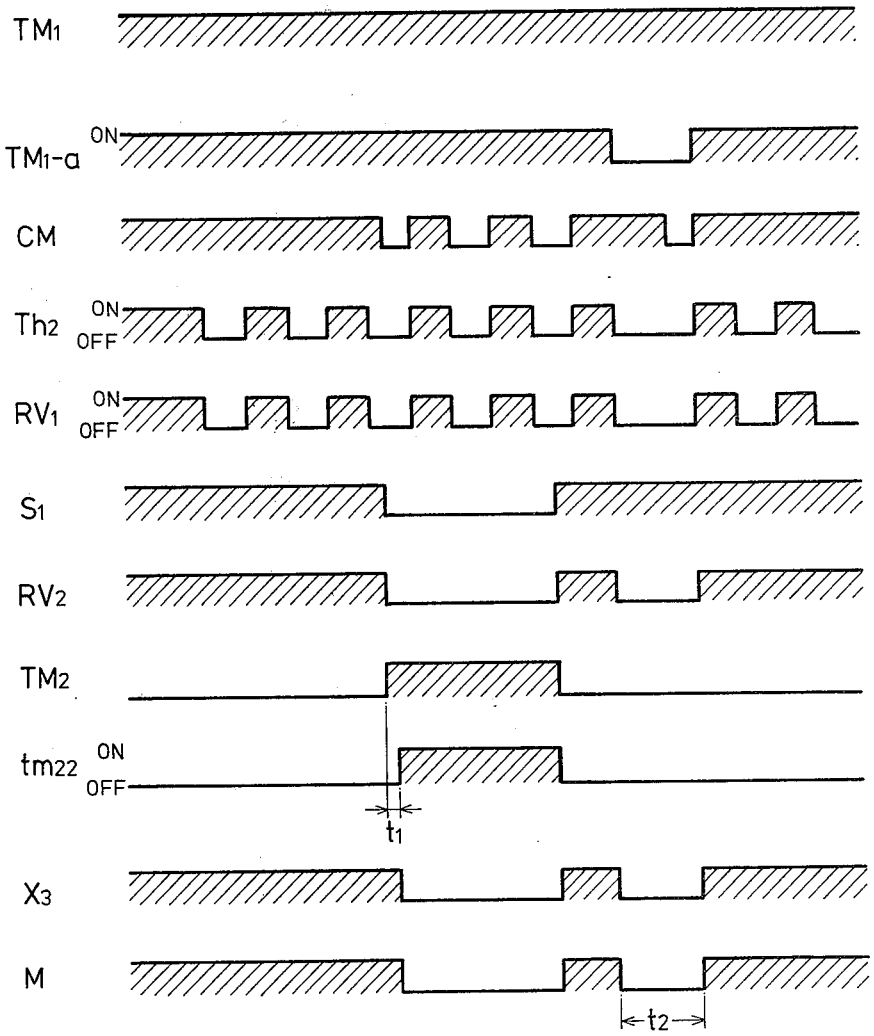
FIG. 9 is a time chart showing an operational state of the control circuit of FIG. 8.

The operations of the control circuit of the electric refrigerator with the automatic ice-making unit as hereinbefore described will be appreciated with reference to the time chart as shown in FIG. 9.

Figure 10:
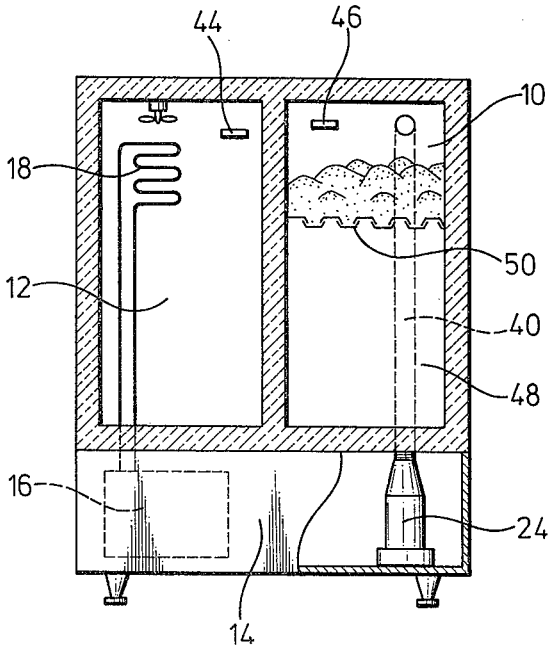
FIG. 10 is a longitudinally sectioned front elevation of the electric refrigerator with an automatic ice-making unit of another embodiment according to the invention.

In the electric refrigerator with the automatic ice-making unit according to the invention as shown in FIG. 10, the ice-storing chamber 10 may be arranged in parallel relation to the refrigerating chamber 12, whereas a separate refrigerating chamber 48 may be arranged below the ice-storing chamber 10 with an air-pervious or porous partition 50 so that the refrigerating chamber 48 may be maintained in a cold and humid environment on account of the cold air circulated from the ice-storing chamber 10.

Figure 11:
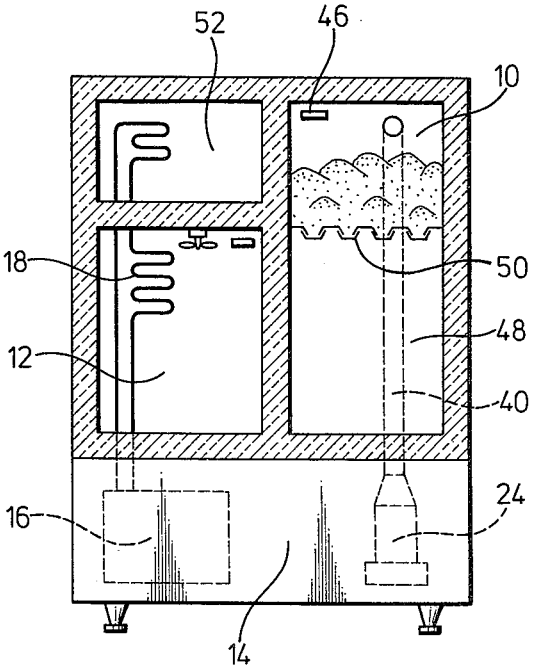
FIG. 11 is a longitudinally sectioned front elevation of the electric refrigerator with an automatic ice-making unit of a further embodiment according to the invention.

Further, a freezing chamber 52 may be arranged in an abutting relation to the refrigerating chamber 12 refrigerated by the cooling unit 16. In this case, the refrigeration of the freezing chamber 52 may be performed by incorporating a freeze evaporator to the cooling unit 16 as shown in FIG. 11.

In accordance with the electric refrigerator of the present invention, the ice-making unit may be compacted to increase the volume of the refrigerating chamber sufficiently as compared with a given outer size. Further, the ice produced by the auger type ice-making unit may be conveniently transported to any desired position in the refrigerator so that the ice-making unit may be positioned at any desired place in the refrigerator. As a result, the machineries including the ice-making unit and the cooling unit may be arranged at a lower position in the refrigerator which stabilizes the refrigerator. Moreover, the auger type ice-making unit does not require any ice-removing operation, which simplifies the construction with the reduced cost but enables the continuous ice-making operation.

Still further, in accordance with the electric refrigerator with the automatic ice-making unit of the invention, the refrigeration system including the cooling unit and the ice-making unit may be operated by a single compressor with the simple control circuit and an improved good operational efficiency as well as convenient maintenance and inspection.

While certain preferred embodiments of the invention have been illustrated by way of example in the drawings and particularly described, it will be understood that various modifications may be made without departing from the spirit and scope of the invention.

What is claimed is:

1. A combination refrigerator and automatic ice making apparatus comprising a housing in which is located (a) a refrigerator chamber, (b) an auger type ice making unit insulatingly spaced from said refrigerator chamber, (c) a bin for storage of ice only and insulatingly separated from both said auger type ice making unit and said refrigerator chamber, (d) conduit means for passage of ice from said auger type ice making unit to said bin and (e) a cooling system located in said housing comprising a compressor, a condensor and evaporators associated respectively with said refrigerator chamber and said auger type ice making unit, the evaporators for said refrigerator chamber and auger type ice-making unit being connected in parallel through respective changeover valves for refrigerant to the refrigeration system, one of the changeover valves being controlled by a temperature sensitive element for detecting the temperature in the refrigerating chamber, the other of the changeover valves being controlled by an ice detecting switch arranged in the ice-storage chamber, and the evaporator for said refrigerator chamber communicating with a delivery side of the compressor for the refrigerant through a hot gas by-pass line having a hot gas valve which is periodically energized for opening, while all of the changeover valves for the refrigerant are closed, by means of a cam timer.

2. The combination according to claim 1, wherein a wet refrigerating chamber is located below said ice storage bin and is cooled by the ice stored therein, being separated from said wet refrigerating chamber by means of an air-pervious partition.

3. The combination according to claim 1, further comprising door means for independently gaining access to each of said refrigerator chamber and ice storage bin.

4. The combination according to claim 1 wherein said auger-type ice making unit comprises a cooling cylinder formed with an opening at its upper end and provided about its outer periphery with an evaporator of a coil configuration, a water supply pipe communicating with a bottom of the cooling cylinder for supplying water to said cylinder, a shaft with a worm rotatably mounted in said cylinder to scrape off a thin ice layer formed on the inner cylindrical surface of said cylinder and to then move the scraped ice toward the opening, and a driving means for rotating said shaft and said cylinder being provided at its upper open end with an ice compression die for compressing the scraped ice into an ice mass.

* * * * *